US007461960B2

(12) United States Patent
Opolka et al.

(10) Patent No.: US 7,461,960 B2
(45) Date of Patent: Dec. 9, 2008

(54) LED ILLUMINATION MODULE

(75) Inventors: Rainer Opolka, Solingen (DE); Andreas Timinger, München (DE)

(73) Assignee: Zweibruder Optoelectronics, Solingen (DE)

( * ) Notice: Subject to any disclaimer, the term of this patent is extended or adjusted under 35 U.S.C. 154(b) by 0 days.

(21) Appl. No.: 11/662,309

(22) PCT Filed: May 5, 2006

(86) PCT No.: PCT/DE2006/000777

§ 371 (c)(1), (2), (4) Date: Mar. 8, 2007

(87) PCT Pub. No.: WO2006/119735

PCT Pub. Date: Nov. 16, 2006

(65) Prior Publication Data

US 2007/0263390 A1 Nov. 15, 2007

(30) Foreign Application Priority Data

May 12, 2005 (DE) ..... 20 2005 007 500 U

(51) Int. Cl.
*F21S 8/10* (2006.01)

(52) U.S. Cl. ..... 362/545; 362/334; 362/335; 359/728

(58) Field of Classification Search ..... 362/543, 362/545, 308, 331–335, 339, 340, 498–499; 359/726–728
See application file for complete search history.

(56) References Cited

U.S. PATENT DOCUMENTS

| | | | | |
|---|---|---|---|---|
| 2,215,900 | A * | 9/1940 | Bitner | 362/309 |
| 2,254,961 | A * | 9/1941 | Harris | 362/327 |
| 2,254,962 | A * | 9/1941 | Bitner et al. | 362/327 |
| 2,356,654 | A * | 8/1944 | Cullman | 362/223 |
| 4,770,514 | A * | 9/1988 | Silverglate | 359/728 |
| 6,478,453 | B2 | 11/2002 | Lammers et al. | 362/294 |
| 3,547,423 | A1 | 4/2003 | Marshall | 362/333 |
| 6,724,543 | B1 * | 4/2004 | Chinniah et al. | 359/718 |
| 7,401,948 | B2 * | 7/2008 | Chinniah et al. | 362/326 |

* cited by examiner

*Primary Examiner*—Anabel Ton
*Assistant Examiner*—Julie A. Shallenberger
(74) *Attorney, Agent, or Firm*—Andrew Wilford

(57) ABSTRACT

An LED illumination module has a light-emitting diode and a rotationally symmetrical, one-piece, light-transparent adapter lens centered on a lens axis. This lens has an axially rearwardly open blind hole defined by a radially inwardly directed frustoconical light-receiving side surface and an axially rearwardly directed convex light-receiving base surface. The diode is axially shiftable in the hole. An axially forwardly directed convex light-output surface is coaxially surrounded by an axially forwardly directed and forwardly flaring frustoconical light-output surface. A radially outwardly directed and radially inwardly reflective surface extends generally from a front edge of the axially forwardly directed frustoconical light-output surface to a rear edge of the radially inwardly directed frustoconical surface.

15 Claims, 3 Drawing Sheets

LED ILLUMINATION MODULE

CROSS REFERENCE TO RELATED APPLICATIONS

This application is the US national phase of PCT application DE2006/000777, filed 5 May 2006, published 16 Nov. 2006 as WO 2006/119735, and claiming the priority of German patent application 202005007500.0 itself filed 12 May 2005, whose entire disclosures are herewith incorporated by reference.

FIELD OF THE INVENTION

The invention relates to an LED illumination module having an LED as well as a rotationally symmetrical, one-piece, light-transparent adapter lens provided with an inner converging lens part and an outer reflector part as well as a blind rearwardly open hole.

BACKGROUND OF THE INVENTION

Such LED illumination modules are for example used in flashlights. The flashlights known according to the state of art are provided with a light bulb and have a light head generally conically expanding toward the front surface, at the inside of which a mostly parabolically curved mirror is arranged in the focal point of which the light bulb or its spiral-wound filament is arranged. With this arrangement, an optimal light yield is ensured. Disadvantageously, such curved mirrors are easily contaminated or the mirror surface might pale due to corrosion effects so that light reflection is reduced.

In recent times, flashlights provided with a light-emitting diode have come on the market. Light-emitting diodes consume significantly less power than light bulbs and can mostly be operated at a lower operating voltage so that small battery bodies (mignon cells) are sufficient power sources. In particular, flashlights can be produced in smaller dimensions thanks to the application of light-emitting diodes, so that they can be comfortably carried as key fobs or the like. Thanks to their structure, light-emitting diodes are also particularly insensitive to shocks and jarring in addition to the low power consumption. In addition, light-emitting diodes have an extremely long life, so that the light bulb no longer has to be changed very frequently, as was the case in former times. But even when light-emitting diodes are used as light source, the given light emission needs to be optimally utilized. In principle, a reflector can be used, as is the case in some lamps, but this use brings about the already mentioned disadvantages. Moreover, it is desirable that no such component has to be integrated.

In some flashlights known according to the state of the art, a converging lens is arranged at the light output region, which allows for the emission of an essentially parallel light beam in a position in which the point of the light emissions is on the focal point of the converging lens. In one embodiment a lamp head that can be moved along the longitudinal axis has been proposed, allowing for a variation of the position of the converging lens relative to the LED. Thus, the characteristic of the light beam can be changed to some extent. The design, however, can only be used for light-emitting diodes whose radiation is already focused to the front. If the light-emitting diodes also emit relevant parts of light toward the sides, that is under high angle to their axis, the light is not used. Today's high-performance light-emitting diodes sometimes are realized in such manner that the radiation exits under a large angle relative to the axis. The use of adapter lenses is recommended for such light-emitting diodes.

According to the state of the art, prismatically or ray-like massive lens bodies with a planar or slightly convex front face are known. At the rear face the lens bodies are provided with a recess into which the LED glass body projects. In this context, the annular surface of the LED base does not abut the corresponding annular surface of the lens body in a planar way, the light emission point of the LED being stationary such that the light emitted near the optical axis toward the aperture is refracted by the collimator effect such that a parallel light pencil is formed. The light emitted under a larger angle relative to the optical axis is completely reflected once the so-called critical angle is exceeded and deflected according to the surface curvature as well as according to the reflection angle resulting therefrom. In the case of such an adapter lens, known for example from U.S. Pat. No. 6,478,453 or U.S. Pat. No. 6,547,423, the emitting characteristic of the lamp is fixed.

OBJECT OF THE INVENTION

The object of the present invention consists in the development of an illumination module composed of an LED as well as of an adapter lens.

SUMMARY OF THE INVENTION

The object is attained by a LED illumination having a rotationally symmetrical, one-piece, light-transparent adapter lens that has an inner converging lens part and an outer reflector part and a rearwardly open blind hole that is defined by a beveled or frustoconical surface with arcuate profile and a convex base surface and that has an inner diameter allowing for axial movement of the LED body within the opening along the optical axis of the adapter lens. This means that the longitudinal and axial movement of the whole arrangement consisting of the LED glass body and the base can be take place in the blind hole-like bore, so that, by a relative movement of the LED to the blind hole-like bore along the optical axis, different emission characteristics with different cone angles of the light emission pencils can be variably set.

The converging lens part has a convex surface as light incidence region and a front light output region, which is convex as well. The reflector part directly connected at the outside of the frame of the one-piece adapter lens is essentially formed by the surface of the blind hole as light incidence region, an outer jacket-like surface as surface that totally reflects the light and an a front conical light output region. All light incidence and light output regions refract diagonal light rays such that the light emitted by the LED is essentially completely, particularly to more than 85%, emitted to the front and a light cone modification of a light cone having a cone angle of $\leqq 12°$ up to a cone angle of $\geqq 20°$ can be generated. In at least one position of the LED relative to the blind hole of the adapter lens, an inner light cone can be homogeneously illuminated over a cross section surface perpendicular relative to the optical surface, preferably such that at a distance of 2.5 m a circle of a diameter of 0.8 m is homogeneously illuminated. Since this all depends only on the movement of the LED relative to the adapter lens, the object can either be attained by an adapter lens that can be moved along the longitudinal axis with the LED fixedly installed or by an LED that can be moved along the longitudinal axis with the adapter lens fixedly installed or by combined movement of the adapter lens as well as of the LED.

The preferred solution consists in the variant where the adapter lens is arranged in a light head that also contains the fixedly installed LED and that can be moved along the longitudinal axis relative to the rest of the lamp body. If required, axial or helical guide can be provided for this purpose.

The movement of the LED out of the focal point or out of a focal-point plane of a lens body in both directions, which can lead to narrow or expanded radiation, i.e. light ray pencils with smaller or larger diameters, is basically known in the state of the art. Up to now, however, the objectives were essentially based on the generation of a light pencil with a largely parallel plurality of single light rays. In case of an intended strict parallelism of the light rays, the illuminated field, however, would be limited, provided that the light source on the diameter of the adapter lens was punctiform. When the LED is moved out of the focal plane, the light cone spreads, but with increasing distance from the optical axis the intensity of light decreases radially outward. Since the adapter lens of the Fresnel type is provided with a converging lens part as well as with a reflector part, the collimator characteristic of the converging lens with the reflector characteristic of the outer part of the adapter lens can be combined in such way that both converging and diverging light rays illuminate a homogenous surface in certain spacings of the light-emitting diode from the adapter lens, particularly at a distance of 2.5 m in a diameter of 80 cm.

The light refracting or totally reflecting surfaces can be determined means of a 2 D customizing procedure.

Embodiments of the invention are described in the dependent claims.

Thus, a tilt angle, under which the light output region of the reflector part is set relative to a perpendicular from the optical axis is between 35° and 40°, preferably 37°. The smallest diameter of the frustoconical hole should be at least 9 mm, thereby allowing that all standard light-emitting diodes, including their bases, can be longitudinally moved along the axis within the opening, also in such a way that the LED, including its base, can fit into the rear hole. The overall length of the adapter lens is supposed to be between 9 mm and 16 mm, which is made possible by combination of a converging lens part with an outer reflector part. Preferably, the inner diameter of the converging lens part is at most 1 mm larger than the largest diameter of the opening of the adapter lens.

According to a further embodiment, the reflector part can have outer edge portions that extend parallel to the optical axis of the adapter lens, thereby preventing the generation of scattered light in the edge surface.

The reflector part may further be provided with an annular array of parts around the opening and perpendicular to the optical axis and/or at the outer front face and perpendicular to the optical axis. In particular, the ratio of the diameter of the adapter lens to its length is between 0.4 and 0.5 and preferably between 0.44 and 0.49. The ratio between the thickness of the inner converging lens to the length of the adapter lens is between 0.6 and 0.65, preferably 0.614. The ratio of the diameters of the inner converging lens part to the diameter of the adapter lens is between 0.5 and 0.55. Finally, the inner converging lens part has a light output region, whose radius of curvature is smaller than the radius of curvature of the light incidence region. According to the invention, the converging lens part has an apex angle of at least 40°, preferably 42°.

The adapter lens preferably consists of plastic, particularly PMMA or glass.

BRIEF DESCRIPTION OF THE DRAWING

Further advantages are described by means of the drawings.

SPECIFIC DESCRIPTION

Figure 5:
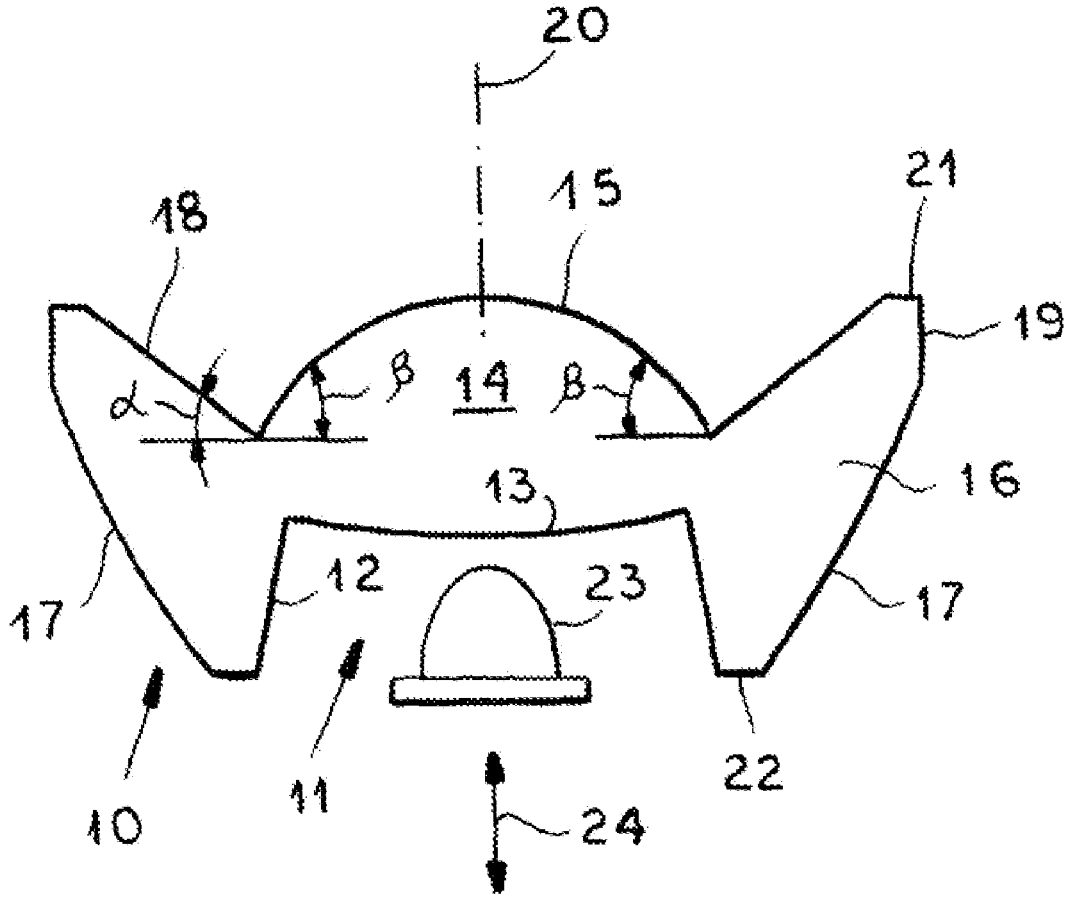

The adapter lens acting as lens body has a rearwardly open blind hole 11 that is defined by a frustoconical side surface 12 as well as by a convex base surface 13 all centered on an axis 20. The base surface 13 is also the light incidence region of an inner converging lens part 14 provided with a convex light output region 15 on the front face. The converging lens part 14 is surrounded by a reflector part 16 that is essentially formed by the surface 12 as light incidence region as well as by an outer annular surface 17 as surface that totally reflects light and by a front conical light output region 18. As shown, the reflector part 16 can also have an annular outer surface 19 extending parallel to the optical axis, as well as of edge surfaces 21 and 22 extending perpendicular to the optical axis 20. The overall diameter of the adapter lens shown in FIG. 5 may, for example, amount to 20 mm, 25 mm or 36 mm, at a construction length of respectively 9 mm, 11 mm or 16 mm. The hole 11 is so wide or the diameter of the opening is so large that an LED 23, which is schematically indicated in FIG. 5, can be moved together with its base along the optical axis 20 (see double arrow 24). Different emission characteristics are shown in FIGS. 1 to 4. A relatively tight pencil leading for example to a homogeneously illuminated circular surface of 0.8 m at a distance of 2.5 m is achieved with a setting according to FIG. 1. The light emitted by the LED 23 is refracted when it meets the light incidence region 13 and, after a second light refraction, leaves the converging lens part 14 through the light output region 15. The frustoconical surface 12 refracts the edge rays onto the outer surfaces 17, where they are totally reflected and finally leave to the front after refraction from the light output region 18. The emission characteristic obtained with the adapter lens 10 and the lens 23 in the shown position, consists in a relatively narrow light cone with small cone angle.

Figure 2:
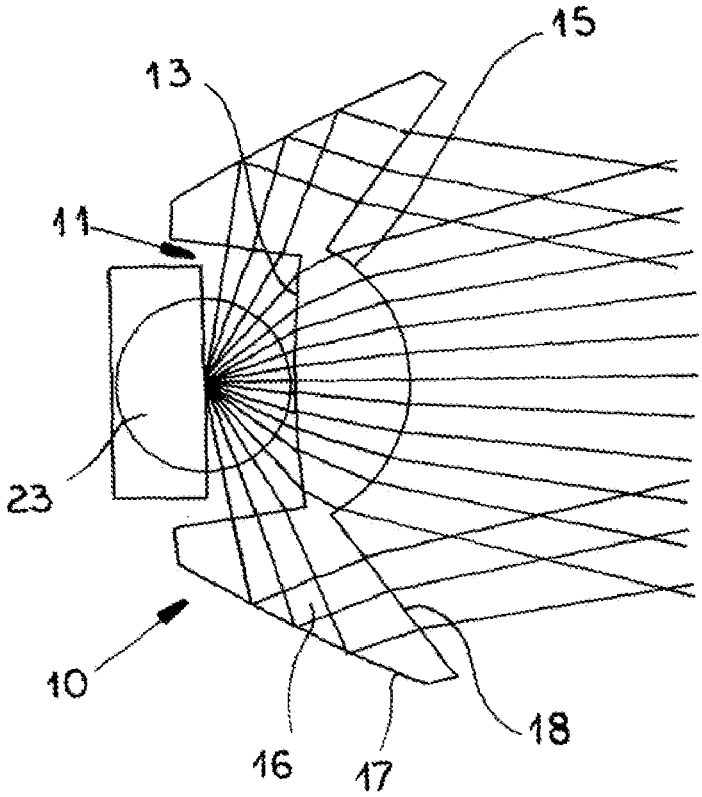

In the position of the LED 23 according to FIG. 2, in which the LED is moved further forward into the hole 11, however, a radiation characteristic is obtained whereby the light rays refracted by the converging lens part 14 diverge and the light rays deriving from the reflector part converge, which is due to different calculation and reflection angles.

Figure 1:
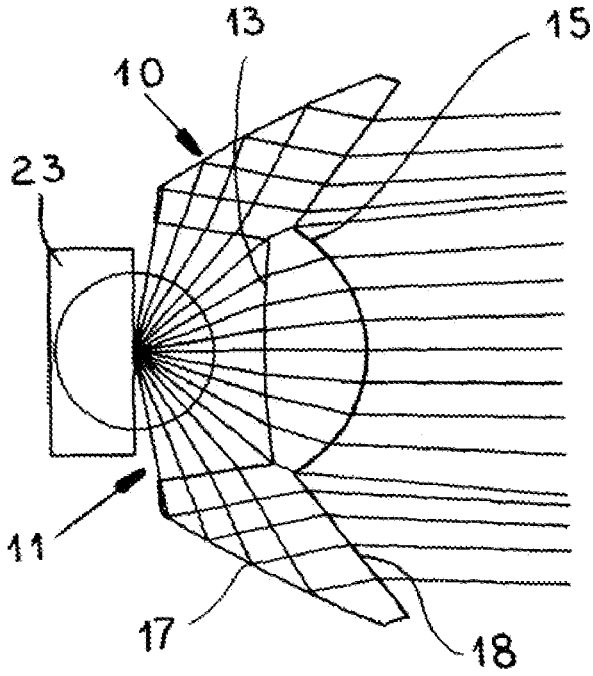
FIGS. 1 to 4 schematically show different emission characteristics with two different adapter lenses and FIG. 5 is a cross section of an actual adapter lens according to the present invention.
Figure 3:
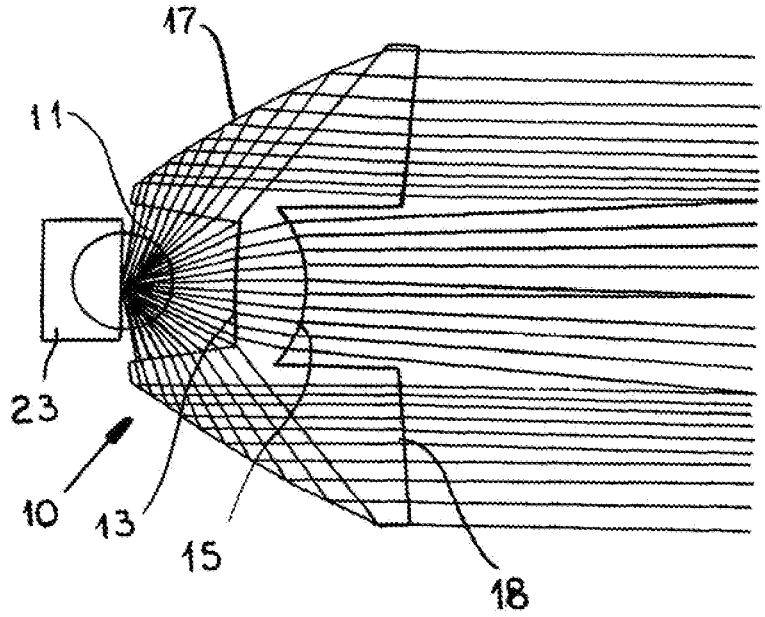
Figure 4:
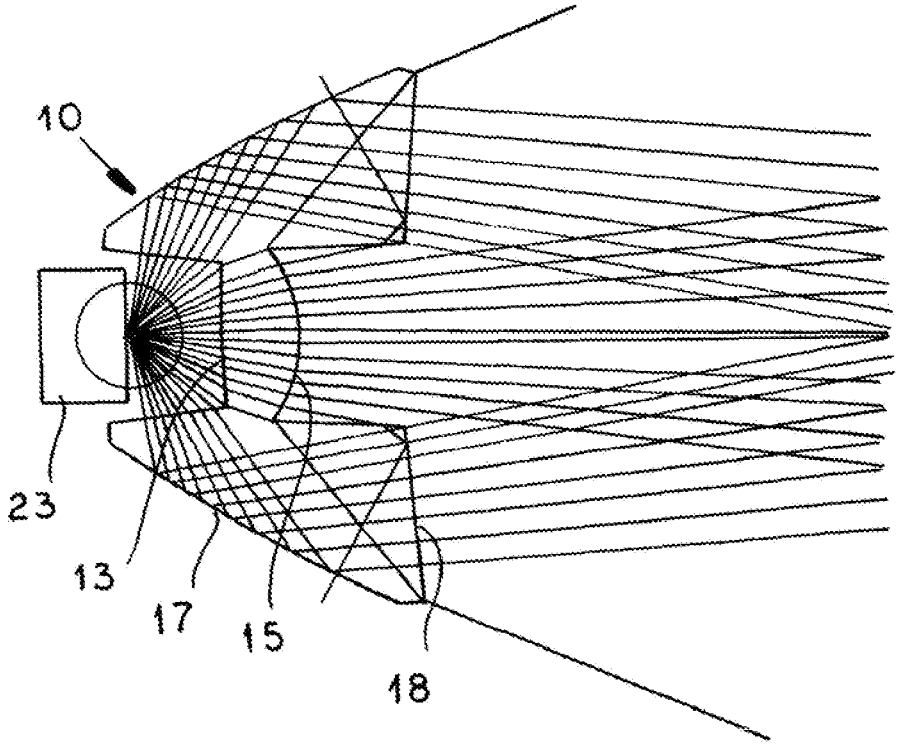

In FIGS. 1 and 2 a lens in a relatively flat design was used. The lens shown in FIGS. 3 and 4 differs therefrom by a greater physical length, the surfaces 17 being extended "toward the front and the back" so that a relatively deeper blind hole 11 and a greater projection of the front surfaces 18 compared to the inner light output region 15 is achieved. In FIG. 3 and in FIG. 4, the light-emitting diode 23 is shown in different positions relative to the adapter lens 10, which leads to different light characteristics.

As shown in FIG. 5 the frustoconical reflector surface extends at a tilt angle $\alpha$ relative to a perpendicular from the optical axis 20 of between 35° and 40°, preferably 37°. In addition the forwardly directed converging lens surface 15 has an apex angle $\beta$ of at least 40°, preferably 42°.

Within the framework of the present invention, variants can be realized having the effect that the surfaces 12 might be designed spherically or aspherically and that the surfaces 13 and 14 might be designed spherically or flat (and not aspherically as shown).

The optical head preferably consists of PMMA and can be used particularly in 12 V units as well as in flashlights.

The invention claimed is:

1. An LED illumination module provided with a light-emitting diode as well as with a rotationally symmetrical, one-piece, light-transparent adapter lens with an inner converging lens part and an outer reflector part wherein a rearwardly open blind hole is defined by a frustoconical or conical side surface with an arcuate shape and by a convex base surface and has an inner diameter allowing for longitudinal movement of the LED body along the optical axis of the adapter lens within the hole, wherein the converging lens part is formed by the convex base surface as a light incidence region and by a front light output surface that is also convex, and wherein the reflector part is essentially formed by the side surface of the hole as another light incidence region, by an outer annular surface that reflects all light inward and a front, frustoconical, light output surface, wherein all the light incidence regions and output surfaces refract the light rays with diagonal incidence angle such that the light emitted by the LED is more than 85% emitted to the front and that, by movement of the LED along the longitudinal axis, a light cone modification of a light cone with a cone angle of $\leqq 12°$ up to a cone angle of $\geqq 20°$ can be generated and wherein in at least one position of the LED relative to the hole of the adapter lens an inner section of the light cone over a cross section surface perpendicular to the optical axis is homogeneously illuminated.

2. The LED illumination module according to claim 1 wherein a tilt angle of the reflector part is set relative to a perpendicular to the optical axis is between 35° and 40°.

3. The LED illumination module according to claim 1 wherein the smallest diameter of the frustoconical hole is $\geqq 9$ mm.

4. The LED illumination module according to claim 1 wherein the total length of the adapter lens is between 9 mm and 16 mm.

5. The LED illumination module according to claim 1 wherein the diameter of the converging lens part is at most 1 mm larger than the largest diameter of the hole of the adapter lens.

6. The LED illumination module according to claim 1 characterized wherein the reflector part has an outer annular surface extending parallel to the optical axis of the adapter lens.

7. The LED illumination module according to claim 1 in wherein the reflector part has a rear outer annular surface that extends around the hole and perpendicular to the optical axis and a front outer annular surface on the outside of the front face and perpendicular to the optical axis.

8. The LED illumination module according to claim 1 wherein the ratio of the diameter of the adapter lens to its length is between 0.4 and 0.5.

9. The LED illumination module according to claim 1 wherein the ratio of the thickness of the inner converging lens to the length of the adapter lens is between 0.6 and 0.65.

10. The LED illumination module according to claim 1 wherein the ratio between the diameter of the inner converging lens part to the diameter of the adapter lens is between 0.5 and 0.55.

11. The LED illumination module according to claim 1 wherein a light output region of the inner converging lens part has a radius of curvature that is smaller than a radius of curvature of the light incidence region.

12. The LED illumination module according to claim 1 wherein the converging lens part has an opening angle of $\geqq 40°$.

13. The LED illumination module according to claim 1 wherein the adapter lens is made of plastic or of glass.

14. An LED illumination module comprising a light-emitting diode and a rotationally symmetrical, one-piece, light-transparent adapter lens centered on a lens axis, the lens being formed with an axially rearwardly open blind hole centered on the axis and defined by a radially inwardly directed frustoconical light-receiving side surface and an axially rearwardly directed convex light-receiving base surface, the hole receiving the light-emitting diode and having an inner diameter allowing for axial movement of the light-emitting diode in the hole, an axially forwardly directed convex light-output surface centered on the axis, an axially forwardly directed and forwardly flaring frustoconical light-output surface coaxially surrounding the convex surface, and a radially outwardly directed and radially inwardly reflective surface extending generally from a front edge of the axially forwardly directed frustoconical light-output surface to a rear edge of the radially inwardly directed frustoconical surface.

15. An LED illumination module provided with a light-emitting diode as well as with a rotationally symmetrical, one-piece, light-transparent adapter lens with an inner converging lens part and an outer reflector part wherein a rearwardly open blind hole is defined by a frustoconical or conical side surface with an arcuate shape and by a convex base surface and has an inner diameter allowing for longitudinal movement of the LED body along the optical axis of the adapter lens within the hole, wherein the converging lens part is formed by the convex base surface as a light incidence region and by a front light output surface that is also convex, and wherein the reflector part is essentially formed by the side surface of the hole as another light incidence region, by an outer annular surface that reflects all light inward and a front, frustoconical, light output surface, wherein all the light incidence regions and output surfaces refract the light rays with diagonal incidence angle such that the light emitted by the LED is more than 85% emitted to the front and that, by movement of the LED along the longitudinal axis, a light cone modification of a light cone with a cone angle of $\leqq 12°$ up to a cone angle of $\geqq 20°$ can be generated and wherein in at least one position of the LED relative to the hole of the adapter lens an inner section of the light cone over a cross section surface perpendicular to the optical axis is homogeneously illuminated, and wherein a tilt angle of the reflector part is set relative to a perpendicular to the optical axis is between 35° and 40°.

* * * * *